United States Patent [19]

Mugnai

[11] Patent Number: 4,832,371

[45] Date of Patent: May 23, 1989

[54] UNIVERSAL PAPER FILE WITH INSIDER GLUED BACK FOR BUNDLING DOCUMENTS

[75] Inventor: Guido Mugnai, Bologna, Italy

[73] Assignee: Unibind Limited, Nicosia, Cyprus

[21] Appl. No.: 119,722

[22] Filed: Nov. 12, 1987

[30] Foreign Application Priority Data

Nov. 13, 1986 [GB] United Kingdom ..... 8627197

[51] Int. Cl.[4] ..... B42D 1/04

[52] U.S. Cl. ..... 281/29; 156/307.3; 281/21.1; 412/900; 412/37

[58] Field of Search ..... 156/307.3, 908; 281/21 R; 412/11, 37, 900; 251/29

[56] References Cited

U.S. PATENT DOCUMENTS 3,531,358 9/1970 Rost et al. ..... 281/21 R X
3,954,548 5/1976 Polit ..... 412/11 X
3,995,886 12/1976 Staats ..... 412/900
4,371,195 2/1983 Wang et al. ..... 412/37 X
4,660,858 4/1987 Flanagan ..... 281/21 R
4,715,919 12/1987 Fakirov et al. ..... 156/307.3

FOREIGN PATENT DOCUMENTS 6711263 2/1969 Netherlands ..... 281/21 R

*Primary Examiner*—Paul A. Bell
*Attorney, Agent, or Firm*—Bacon & Thomas

[57] ABSTRACT

Universal paper file with inside glued back for bundling documents, of the type consisting of a front cover, a back cover and a back, the inside of the back containing a glue layer including a thermosetting glue, wherein both the glue of said glue layer and the back of the paper file are made of materials that, upon thermal activation, enter into a chemical reaction to form a mutual permanent bond therebetween.

3 Claims, No Drawings

UNIVERSAL PAPER FILE WITH INSIDER GLUED BACK FOR BUNDLING DOCUMENTS

The present invention relates to a universal paper file with an inside glued back for bundling documents, more especially of the type consisting of a front cover, a back cover and a back, which at the inside contains at least one glue layer made of a thermosetting glue.

Paper files for binding documents, wherein a layer of a thermosetting glue is provided at the inside of the back are known in various variants and embodiments. Paper files of that kind and the process for applying them are known, e.g., from the French Pat. No. 2,189,215, the U.S. Pat. No. 3,954,548 and the Belgian Pat. No. 869,886. According to those patents the back is placed against the documents, which are provided with it by heating, whereby the thermosetting glue forms a proper adhesion with the documents.

The above mentioned embodiments, however, have the disadvantage that the paper files come loose, especially after some time, although the proper bundle of documents remains adhered. For by varying climatic conditions as well as by phenomena of fatigue and ageing, the quality of adhesion of the glue layer to the inside of the back is impaired after some time.

Thus it is an object of the present invention to provide a universal paper file with an inside glue layer for thermosetting glue systems, wherein by using said paper file the above mentioned disadvantage is excluded systematically, in other words, wherein a permanent adhesion between the glue layer and the inside of the back is realized.

For that purpose, this invention consists of a universal paper file with an inside glued back for bundling documents of the type consisting of a front cover, a back cover and a back which at the inside contains a thermosetting glue, characterized thereby that the glue of said glue layer as well as the back of the paper file consist of materials which upon thermal activation enter into a chemical reaction, that provides a mutual permanent chemical bond therebetween.

Upon composing universal paper files of that kind, the glue layer is applied to the inside of the back in a conventional way. At normal temperature, no chemical bond forms between this glue layer and the material of the back, in other words the glue layer co-operates with the back by its normal adhesive power.

When a paper file is applied around a bundle of documents, the back and its immediate surroundings are heated by means of apparatus known by themselves. By selecting the glue at the one hand, and of the material of the back at the other hand it is now achieved according to the invention that during the thermal activation a chemical reaction takes place and a bond forms between both materials, which ultimately provides a permanent bond between the glue layer and the back. The bond between the glue layer and the bundle of documents occurs in the normal way through the adhesive power of the glue.

As an example, when a back is used for a paper file made of polyvinylchloride (PVD) a glue will be employed capable of forming a hydrogen bond with the chlorine of the PVC.

It is clear that the back of the paper file may consist of a material different from PVC, but then a suitable sort of glue has to be chosen in order to provide a chemical bond according to the invention.

The present invention is by no means limited to the embodiment described as an example, but suchlike universal paper file with inside glued back for bundling documents, and more especially the selection of the glue at the one hand and of the material of the back at the other hand may consist in distinct variants without departing from the scope of the present invention.

I claim:

1. A universal paper file of the type including a front cover, a back cover and a back having an inside, wherein a bundling of documents is disposed between the covers and bonded to the inside of the back with a layer of glue, the improvement comprising the back and layer of glue being formed of materials capable of undergoing a heat activated chemical reaction therebetween to provide a permanent chemical bond between the back and layer of glue.

2. The universal paper file of claim 1 wherein the back is formed of a material including polyvinylchloride and the glue is formed of a material capable of undergoing a chemical reaction to form a hydrogen bond with the chlorine of the polyvinylchloride.

3. The universal paper file of claim 1 wherein the layer of glue includes a thermosetting glue.

* * * * *